United States Patent [19]

Jaeschke

[11] 4,305,500

[45] Dec. 15, 1981

[54] BOTTLE CARRIER

[75] Inventor: Harold R. Jaeschke, Milwaukee, Wis.

[73] Assignee: Champion International Corporation, Stamford, Conn.

[21] Appl. No.: 160,993

[22] Filed: Jun. 19, 1980

[51] Int. Cl.[3] ..... B65D 75/00

[52] U.S. Cl. ..... 206/153; 206/158; 206/147; 294/87.2

[58] Field of Search ..... 206/153, 147, 151, 158, 206/427, 45.14; 294/87.2, 87.26; 229/22, 23 C

[56] References Cited

U.S. PATENT DOCUMENTS

| | | | |
|---|---|---|---|
| 3,016,259 | 1/1962 | Lawrence | 206/158 X |
| 3,387,879 | 6/1968 | Wood | 294/87.2 |
| 3,528,697 | 9/1970 | Wood | 206/158 X |
| 3,640,563 | 2/1972 | Wood | 294/87.2 |
| 3,784,246 | 1/1974 | Klygis | 206/158 X |
| 3,860,281 | 1/1975 | Wood | 206/158 X |
| 4,180,191 | 12/1979 | Wood | 206/147 X |
| 4,218,086 | 8/1980 | Klygis | 206/153 X |

*Primary Examiner*—Steven M. Pollard
*Attorney, Agent, or Firm*—Evelyn M. Sommer

[57] ABSTRACT

A carrier for bottles having flanged neck portions is disclosed. The subject carrier includes a generally tubular triangle formed from a horizontal bottom panel hingedly connected to a pair of inclined side panels. The bottom panel is provided with openings which are vertically aligned with flange receiving apertures located at the apex of the triangular configuration. The bottles are received through the openings in the bottom panel, with the flanged neck portions being supported by the edges of the flange receiving apertures in the side walls. A plurality of inner support triangles are provided each including an apex coincident with the apex of the outer triangle and having side walls which are in abutting relationship with, and adhesively connected to, the inner surfaces of the adjacent side walls of the outer triangle. The bottom panel of each inner triangle acts as a support member which inhibits the spreading of the side walls of the outer triangle to prevent the accidental release of the bottles. Further, the bottom panel of the central inner triangle adds rigidity to the handle structure of the carrier. In a preferred embodiment, a tear strip for each flange receiving aperture is provided, in a side wall of the carrier, to facilitate the release of the bottle therefrom.

12 Claims, 5 Drawing Figures

BOTTLE CARRIER

BACKGROUND OF THE INVENTION

The subject invention relates to a carrier for bottles having flanged neck portions. More particularly, a carrier is disclosed, having a generally tubular triangular configuration, and including apertures for gripping the flanged neck portions of the bottles.

In the prior art, various paperboard holders have been developed for carrying bottles. Recently, to minimize the amount of paperboard necessary for their construction, carriers have been developed for gripping the upper neck portions of a bottle, in contrast to the earlier, wrap-around type container. Accordingly, it would be desirable to provide a new and improved carrier which requires less paperboard in its manufacture, while possessing sufficient strength and rigidity to support heavy bottles.

Therefore, it is an object of the subject invention to provide a new and improved carrier for holding bottles having a unique inner support triangle construction which provides structural rigidity, while utilizing a minimum amount of paperboard.

It is another object of the subject invention to provide a new and improved carrier for flanged bottles having a structurally reinforced handle portion.

It is a further object of the subject invention to provide a carrier which can be shipped in a flattened configuration and is capable of gripping and holding bottles having a flanged neck portion.

SUMMARY OF THE INVENTION

In accordance with these and many other objects, the subject invention includes a bottle carrier of generally tubular triangular configuration which includes a horizontal bottom panel hingedly connected to a pair of inclined side panels, which meet at an apex. The bottom panel is provided with relatively large apertures for receiving the bottles to be carried. The side panels include opposed pairs of die cuts which cooperate to define relatively smaller apertures for receiving the flanged portions of the bottle. Each flange receiving aperture is vertically aligned with an aperture in the bottom panel. In accordance with the subject invention, a plurality of the unique inner support triangles are provided for adding structural rigidity to the carrier. The inner support triangles include an inner bottom panel, hingedly connected to a pair of inclined inner side panels. The vertex of each inner support triangle is coincident with the vertex of the outer triangle, while the inner side panels are in face to face abutting contact with, and adhesively connected to the inner surface of the adjacent side panels of the outer triangle. By this arrangement, the inner bottom panel acts as a cross member which inhibits the inadvertent spreading of the side panel which can result in the accidental and premature release of the bottles.

Preferably, a pair of arcuate die cuts are provided in the side panels which define handle tabs that are inwardly foldable into coplanar relationship with the bottom panel of an inner support triangle, to provide a structurally rigid handle portion. The latter arrangements provide a triple ply thickness of paperboard at the handle of the carrier to reduce the likelihood of tearing. Thus, the inner support triangles, which are formed from a relatively small amount of paperboard, significantly enhance the overall structural rigidity of the carrier.

In a preferred embodiment of the subject invention, a tear strip is provided for each flange receiving aperture. Each tear strip, which is defined by a pair of spaced apart cut lines, extends from the flange receiving aperture to the bottom panel. A pull tab may be provided connected to the bottom of the tear strip, adjacent the bottom panel to facilitate the tearing of strip to release the bottle.

Further objects and advantages of the subject invention will become apparent from the following detailed description of the preferred embodiment when taken in conjunction with the drawings in which:

DESCRIPTION OF THE PREFERRED EMBODIMENT

Figure 1:
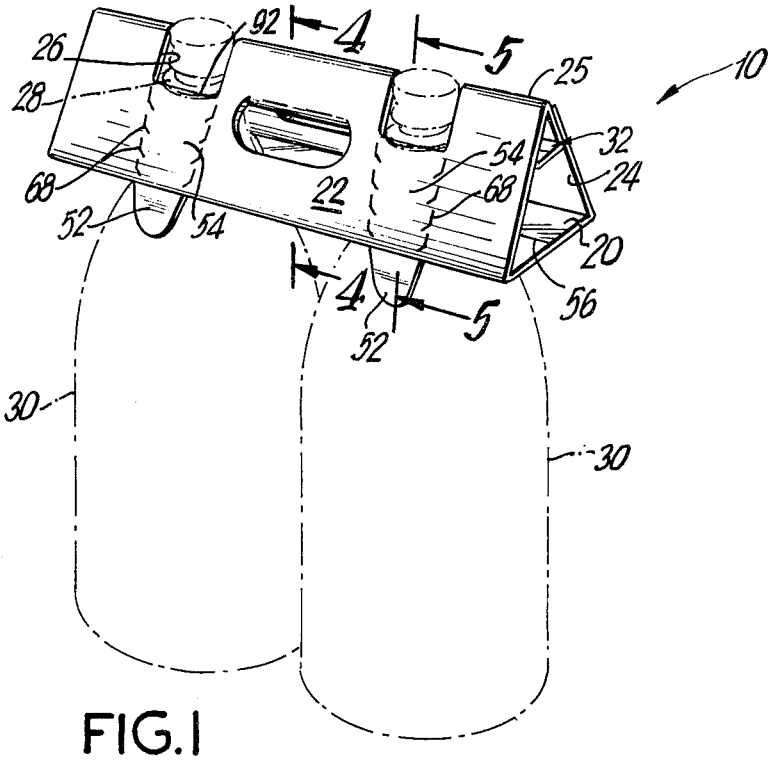
FIG. 1 is a perspective view of the new and improved carrier of the subject invention with bottles having flanged neck portions depending therefrom.

Referring to FIG. 1, the carrier 10 of the subject invention is illustrated and includes a generally tubular outer triangle, having a bottom panel 20 and two inclined side panels 22 and 24, meeting at an apex 25. A pair of flange receiving apertures 26 are formed adjacent apex 25 for gripping the flanged portions 28 of bottles 30, shown in phantom. In accordance with the subject invention, a plurality of inner support triangles 32 are provided and are disposed such that the apex of each inner triangle 32 is coincident with the apex 25 of the outer triangle. As more fully described hereinafter, the inner support triangles function to add structural rigidity to the carrier, while not significantly increasing its cost of manufacture.

Figure 2:
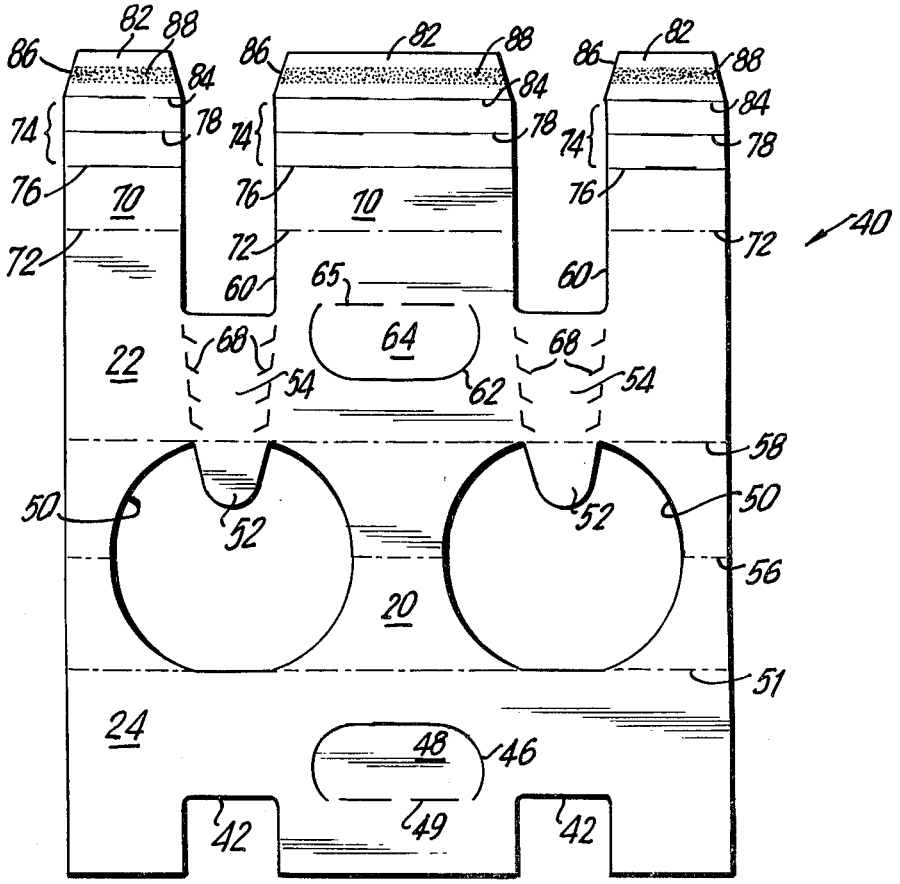
FIG. 2 is a plan view of a blank for forming the new and improved bottle carrier of the subject invention.

Referring to FIG. 2, there is illustrated a plan view of the blank for forming the carrier 10 of the subject invention. Blank 40, which is cut from a planar sheet of paperboard material, is generally rectangular in configuration and includes a plurality of parallel fold lines defining the panels of the carrier. More particularly, and starting from the bottom of FIG. 2, side panel 24 includes a pair of inverted U-shaped die cut portions 42 which cooperate with similar die cuts in the other side panel 22 to define the flange receiving apertures 26, as described more fully hereinbelow. Side panel 24 further includes an arcuate cut line 46 that defines handle tab 48, which is hingedly connected to side panel 24 along fold line 49. In the erected carrier, handle tab 48 is inwardly foldable to form an aperture for grasping the carrier.

Bottom panel 20, which is hingedly connected to side panel 24 along fold line 51, includes a pair of bottle receiving apertures 50. Bottle receiving apertures 50 have a diameter which is large enough to permit the loading of bottles therethrough in the erected carrier. A rounded pull tab 52 projects into each aperture 50 and is connected to a tear strip 54 formed in side panel 22. Pull tabs 52 and tear strips 54 are provided to facilitate the release of the bottle 30 from the carrier as more fully described hereinafter. Bottom panel 20 is preferably provided with a central fold line 56 to enable the carrier to be glued and folded in a flattened configuration to reduce shipping and storage costs.

Side panel 22 is hingedly connected to bottom panel 20 along fold line 58 and is essentially a mirror image of side panel 24. More particularly, side panel 22 includes a pair of U-shaped die cuts 60 which substantially conform to the configuration of the die cuts 42 in side panel 24. Side panel 22 is similarly provided with an arcuate cut line 62 which defines a handle tab 64 that is inwardly foldable, in the erected carrier, to form a gripping aperture. Preferably, a hinge line 65 is provided to facilitate the folding of the handle tab 64. Side panel 22 additionally includes a pair of tear strips 54 which extend from die cuts 60 to fold line 58, adjacent bottom panel 20. Each tear strip is defined by a pair of spaced apart cut lines 68 which are aligned with pull tabs 52 formed in bottom panel 20.

Side panels 22 and 24, in combination with bottom panel 20, function to define a tubular, outer triangular configuration in the erected carrier. In accordance with the subject invention, the remaining portions of blank 40 define tubular inner triangles 32, which function to add structural rigidity to the carrier. In the illustrated embodiment of the subject invention, three inner triangles are provided and are formed from the paperboard segments extending beyond the free edge of side panel 22. Each extending segment, which is connected to side panel 22 along hinge line 72, includes an inner side panel 70, as well as an inner bottom panel 74 which is connected to the inner side panel 70 along fold line 76. Each inner bottom panel 74 may be provided with a central hinge line 78 to facilitate the folding of the carrier into a flattened configuration for shipping. A second inner side panel 82 is hingedly connected to each inner bottom panel 74 along fold line 84. Preferably, the side edges 86 of each inner side panel 82 are tapered to facilitate the erection of the carrier. A central glue line 88 is provided along each inner side panel 82. The above described blank 40 may be folded and glued to form a bottle carrier having a main outer triangle and a plurality of inner support triangles.

Figure 3:
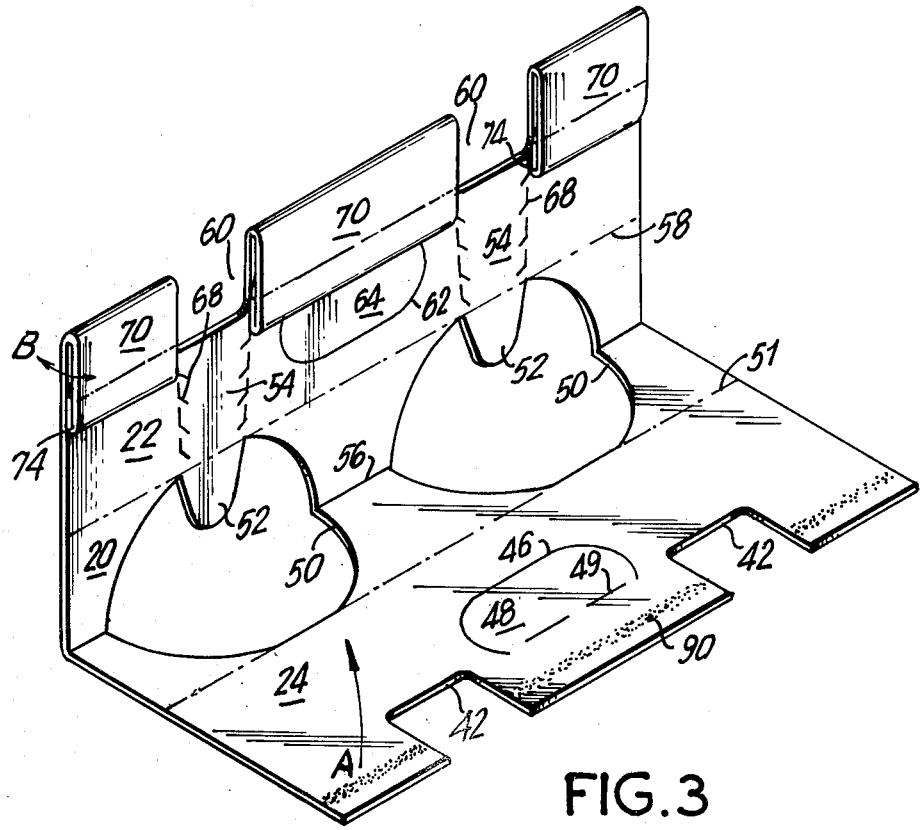
FIG. 3 is a perspective view of an intermediate folding step in forming the new and improved bottle carrier of the subject invention.

Referring to FIG. 3, an intermediate step in the erection of the carrier 10 of the subject invention is illustrated. Initially, the extending segments, for forming the inner support triangles, are folded and glued. More specifically, inner bottom panel 74 is folded (into the plane of the drawing in FIG. 2) about central hinge line 78. Thereafter, the extending segment is folded again in the same direction, about fold line 72 to achieve the triple-ply configuration, illustrated in FIG. 3. The adhesives 88 on side panels 82 secure the latter to the inner surface of side panel 22. The flattened configuration of the inner support triangles facilitates the shipment and storage of the carrier.

To complete the erection of the carrier 10, side panel 24, along with the adjacent portion of bottom panel 24, is folded upwardly in the direction of arrow A about hinge line 56. Preferably an adhesive line 90 is provided along the inner surface of side panel 24 adjacent the free end thereof, enabling side panel 24 to be secured to the outer surface of the inner side panel 70. The carrier 10 may then be readily shipped to the bottle distributor in the flattened configuration thereby saving transportation costs.

In order to load the carrier 10 of the subject invention, side panels 22 and 24 are separated to form the tubular triangular configuration, as illustrated in FIG. 1. The spreading of side panels 22 and 24 functions to separate the inner side panels 70 and 82, as indicated by arrow B in FIG. 3, to form the inner support triangles. The inner side panels 70 and 82 of each inner support triangle meet at an apex 25 which is coincident with the uninterrupted portions of the apex of the outer triangle. The inner bottom panels 74 lie in a plane adjacent the horizontal bottom edges 92 of the flange receiving apertures 26. As illustrated in FIG. 1, the opposed pair of U-shaped die cuts 42 and 60 in side panels 22 and 24 cooperate to define flange receiving apertures 26. The maximum width of the apertures 26, measured horizontally from one side panel to the other, is less than the diameter of the flanged neck portion 28 of bottle 30. The bottles 30 are loaded into the carrier 10 by inserting the neck portions through bottle receiving apertures 50 until the flanged portions 28 pass upwardly, beyond the flange receiving apertures 26. The bottom surface of the flanged portions 28 rest on, and are supported by, the horizontal bottom edge 92 of the flange receiving apertures 28.

Figure 4:
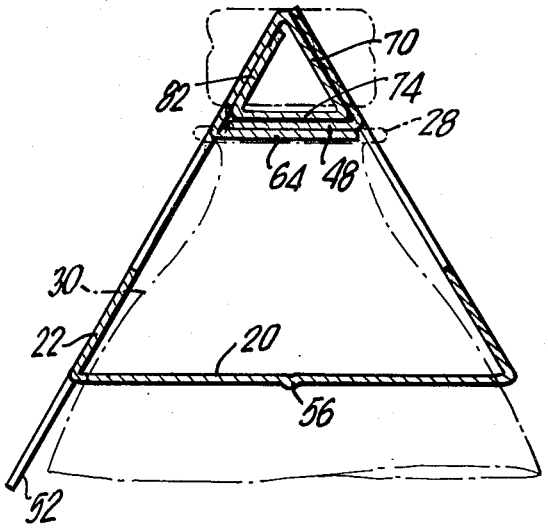
FIG. 4 is a cross-sectional view of the bottle carrier of the subject invention taken along the lines 4—4 in FIG. 1.
Figure 5:
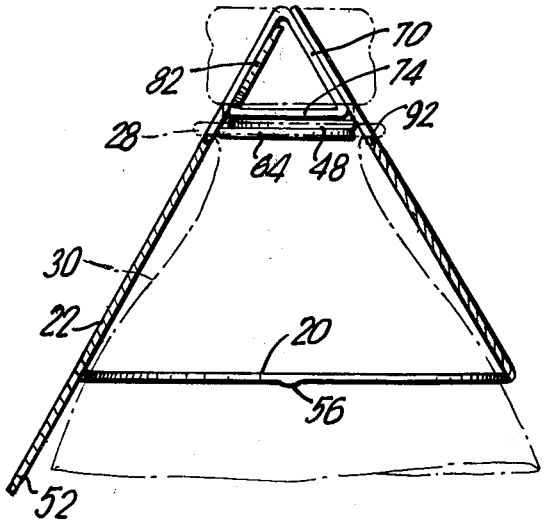
FIG. 5 is a cross-sectional view of the bottle carrier of the subject invention taken along the lines 5—5 in FIG. 1.

In accordance with the subject invention, the unique inner support triangles 32 increase the structural integrity of the carrier 10. More particularly, and as viewed in FIG. 5, each inner bottom wall 74 acts as a cross member, which inhibits the spreading or separation of side panels 22 and 24. By this arrangement, the horizontal width of the flange receiving apertures 26 are effectively maintained a distance less than the diameter of the flanged neck portions 28, thereby preventing the accidental and premature release of the bottles 30. In addition, the central inner support triangle functions to strengthen the handle structure of the carrier. More specifically, and as illustrated in FIG. 4, when the carrier is transported, handle tabs 48 and 64 are folded inwardly into an overlapping, horizontal relationship with each other, and with inner bottom wall 74 of the central inner triangle. By this arrangement, a triple-ply of paperboard is provided where the handle structure is grasped, thereby increasing its strength and inhibiting the tearing of the paperboard when the carrier is transported. Thus, the inner triangles 32, which are formed from a relatively small amount of paperboard, are operative to enhance the structural integrity of the carrier, while not significantly increasing its cost.

To remove a bottle from the carrier, the user merely has to grasp a pull tab 52 and exert an upward pressure thereon to separate the associated tear strip 54 from side panel 22. By removing the tear strip, both a flange receiving aperture 26 and a bottle receiving aperture 50 are opened enabling the ready removal of a bottle 30.

In summary, there is provided a new and improved paperboard carrier for bottles having flanged neck portions, which includes a generally tubular outer triangle formed from a horizontal bottom panel which is hingedly connected to a pair of inclined side panels meeting at an apex. The bottom panel is provided with a plurality of bottle receiving apertures while the side panels are provided with an opposed pair of die cut portions for each bottle receiving aperture in the bottom panel. Each pair of opposed die cut portions cooperate to define a flange receiving aperture which is vertically aligned with a bottle receiving aperture. In accordance with the subject invention, a plurality of tubular inner triangles are provided which are formed from an inner bottom panel hingedly connected to a pair of inclined inner side panels. The apex of each inner triangle is coincident with the apex of the outer triangle, with the inner side panels being in face to face contacting relationship with, and adhesively connected to, the inner surface of the adjacent side panels of the outer triangle. The inner support triangles function to structurally rigidify the carrier without significantly increasing its cost of manufacture. Preferably, the carrier is provided with a tear strip associated with each flange receiving aperture, to facilitate the removal of the bottles therefrom.

Although the subject carrier has been described by reference to a preferred embodiment, it is apparent that other modifications could be devised by those skilled in the art that would fall within the scope and spirit of the present invention as defined by the appended claims.

What is claimed is:

1. A carrier for bottles having flanged neck portions comprising:

a generally tubular outer triangle formed from a horizontal bottom panel hingedly connected to a pair of inclined side panels, said side panels meeting at an apex, said bottom panel having a plurality of bottle receiving apertures and with said side panels having an opposed pair of die cut portions for each bottle receiving aperture in said bottom panel, each said pair of opposed die cut portions cooperating to define a flange receiving aperture, each flange receiving aperture being aligned with one of said bottle receiving apertures in said bottom panel, said tubular outer triangle futher including a tear strip for each said flange receiving aperture, each tear strip being defined by a pair of spaced apart cut lines formed in one of said side panels, said tear strips extending from the associated flange receiving aperture to said bottom panel, and with said side panels further including a pair of opposed aligned apertures to define a carrying handle; and a plurality of tubular inner support triangles, each said inner triangle formed from an inner bottom panel hingedly connected to a pair of inclined inner side panels, said inner side panels meeting at an apex which is coincident with the apex of said outer triangle, said inner triangles being disposed along the portions of said apex of said outer triangle which is uninterrupted by said flange receiving apertures, said inner side panels being in face to face contacting relationship with, and adhesively connected to, the inner surfaces of the adjacent side panels of said outer triangle, said inner triangles being operative to add structural rigidity to said carrier.

2. A carrier as recited in claim 1 further including a pair of handle tabs hingedly connected to the periphery of said aligned apertures defining said carrying handle, said handle tabs being inwardly foldable and capable of being disposed in an overlapping horizontal relationship with the associated inner bottom panel of one of said tubular inner support triangles thereby forming a triple-ply thickness having increased structural rigidity.

3. A carrier as recited in claim 1 wherein said bottom panels of said tubular triangles have a central fold line enabling said carrier to be folded into a flattened configuration.

4. A carrier as recited in claim 1 wherein said inner bottom panels of said inner support triangles lie in a plane adjacent the flanged neck portions of said bottles.

5. A carrier as recited in claim 1 wherein each said tear strip further includes a pull tab hingedly connected at one end thereof.

6. A carrier as recited in claim 5 wherein said pull tab is hingedly connected to the associated tear strip adjacent said bottom panel.

7. A carrier as recited in claim 1 formed from a single sheet of foldable cardboard material.

8. A paperboard blank for forming a carrier for bottles having flanged neck portions comprising:

a first side panel having a plurality of U-shaped die cut portions disposed adjacent one edge thereof;

a bottom panel hingedly connected to the opposed edge of said first side panel and including a bottle receiving aperture for each said die cut portion of said first side panel and aligned therewith;

a second side panel hingedly connected to the opposed edge of said bottom panel and having a U-shaped die cut portion, disposed along the opposed edge thereof, for each said die cut portion in said first side panel and aligned therewith; and a plurality of extended portions, hingedly connected to the portions of said opposed edge of said second side panel which are uninterrupted by said die cuts, each said extension portion including an inner side panel adjacent said second side panel, each said extended portion further including an inner bottom panel hingedly connected to the opposed edge of said inner side panel, and with each said extended portion further including a second inner side panel hingedly connected to the opposed edge of said inner bottom panel.

9. A blank as recited in claim 8 further including a tear strip for each said die cut portion of said second side panel and formed therein, each said tear strip being defined by a pair of spaced apart cut lines, said tear strip extending from said die cut portion to said bottom panel.

10. A blank as recited in claim 9 wherein each said tear strip further includes a pull tab hingedly connected at one end thereof, said pull tab extending into the associated bottle receiving aperture in said bottom panel.

11. A blank as recited in claim 8 wherein said first and second side panels include a handle tab defined by an arcuate cut line.

12. A blank as recited in claim 8 wherein the side edges of said second inner side panels are tapered to facilitate erection of said carrier.

* * * * *